US005777536A

United States Patent [19]

Lee et al.

[11] Patent Number: 5,777,536

[45] Date of Patent: Jul. 7, 1998

[54] SEALED ELECTRIC SWITCH ASSEMBLY

[76] Inventors: Wen-Fong Lee, No. 13-2, Lane 79, Sec. 1, Taichung Kang Rd., Taichung; Ming-Hung Lee, No. 34, Alley 56, Lane 5, Shu-I, Taichung; Ming-Tung Lee; Ming-Yu Lee, both of No. 13-2, Lane 79, Sec. 1, Taichung Kang Rd., Taichung, all of Taiwan

[21] Appl. No.: 857,867

[22] Filed: May 16, 1997

[51] Int. Cl.[6] ..... H01H 9/00

[52] U.S. Cl. ..... 335/172; 335/190

[58] Field of Search ..... 335/8–10, 167–176, 335/185–192

[56] References Cited

U.S. PATENT DOCUMENTS 4,023,127 5/1977 Mune ..... 335/172

5,052,428 10/1991 McColloch et al. ..... 335/172

5,117,208 5/1992 Nar ..... 335/8

*Primary Examiner*—Lincoln Donovan

*Attorney, Agent, or Firm*—Browdy and Neimark

[57] ABSTRACT

A sealed electric switch assembly comprises a magnetic control assembly having first and second magnetic members which is mounted to a top wall of a sealed casing, and an elongated plate having third and fourth magnetic members which is mounted oppositely to the first and second magnetic members so that the elongated plate member can be attracted and repulsed magnetically by the magnetic control assembly. A linkage mechanism is mounted adjacent to the elongated plate member for moving a movable contact of a movable arm to connect and disconnect with a stationary contact. A rotary assembly and a tripping assembly are mounted above the linkage mechanism and over an electromagnet.

5 Claims, 7 Drawing Sheets

SEALED ELECTRIC SWITCH ASSEMBLY

This invention relates to an electric switch assembly, more particularly to a sealed electric switch assembly which can open automatically the circuit under over-load or short-circuit and which can be protected from moisture, dust and corrosion.

In conventional electric switches, especially those used in power circuits, the contacts are exposed to air. Corrosion of the components of these kinds of switches is liable to occur after the switches are used for a period of time, resulting in a poor sensitivity of the switches. In addition, such switches are not suitable for use in dusty, moist, easily explosive or combustible environments.

It is therefore a main object of this invention to provide a sealed electric switch assembly which can be prevented from corrosion of the components in order to maintain good sensitivity and which can be protected from moisture, dust and corrosion in order to be used in various environments.

According to an aspect of the present invention, the sealed electric switch assembly comprises a magnetic control assembly having first and second magnetic members which is mounted to a top wall of a sealed casing and an elongated plate having third and fourth magnetic members which is mounted oppositely to the first and second magnetic members so that the elongated plate member can be attracted and repulsed magnetically by the magnetic control assembly. A linkage mechanism is mounted adjacent to the elongated plate member for moving a movable contact of a movable arm to connect and disconnect with a stationary contact. A rotary assembly and a tripping assembly are mounted above the linkage mechanism and over an electromagnet. Whereby, the electric switch assembly of the present invention can open the circuit when the circuit is converted to the state of over-load or short-circuit in order to achieve the purpose of safe use.

Other features and advantages of this invention will become apparent in the following detailed description of the preferred embodiments of this invention with reference to the accompanying drawings, in which.

Figure 4:
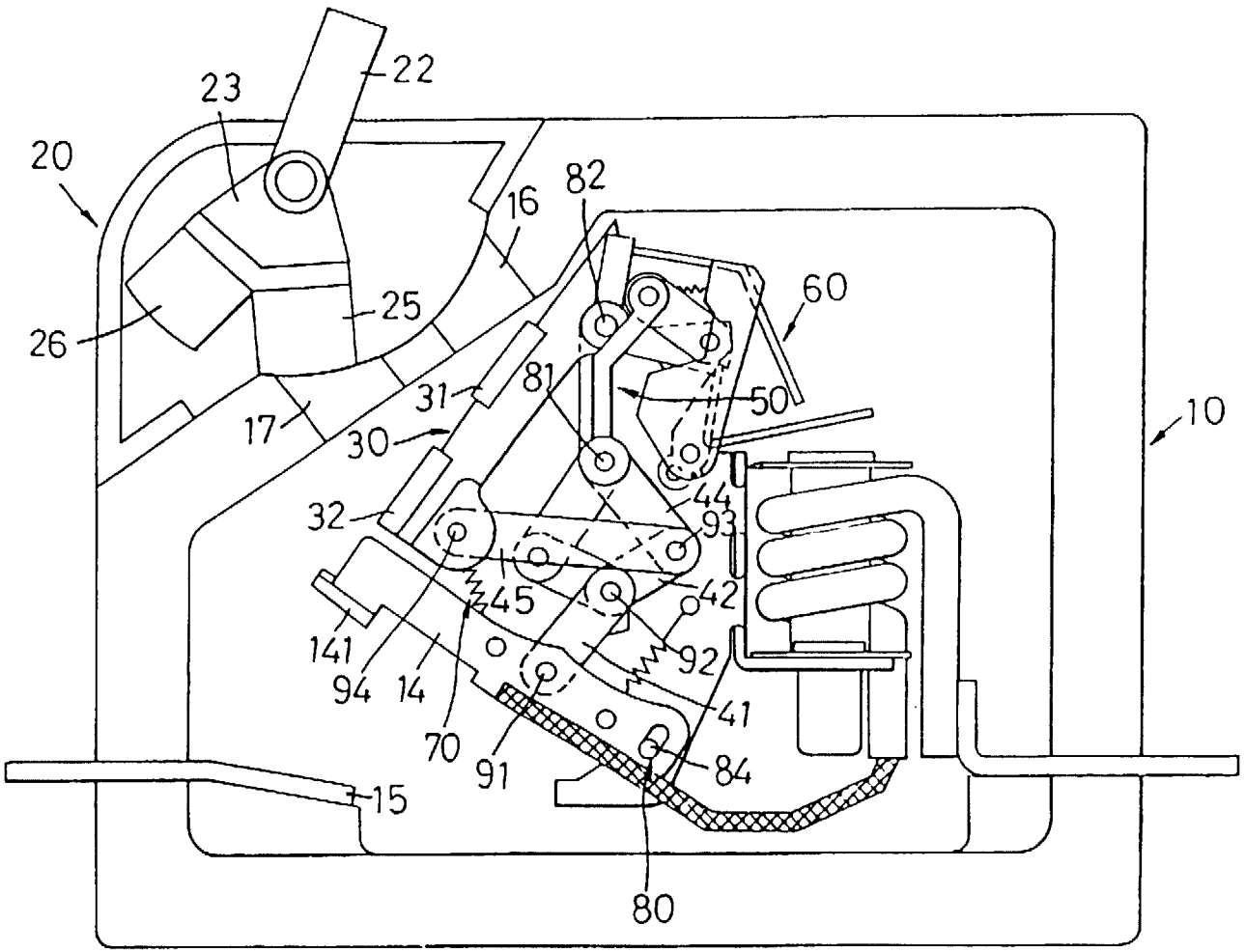
Figure 5:
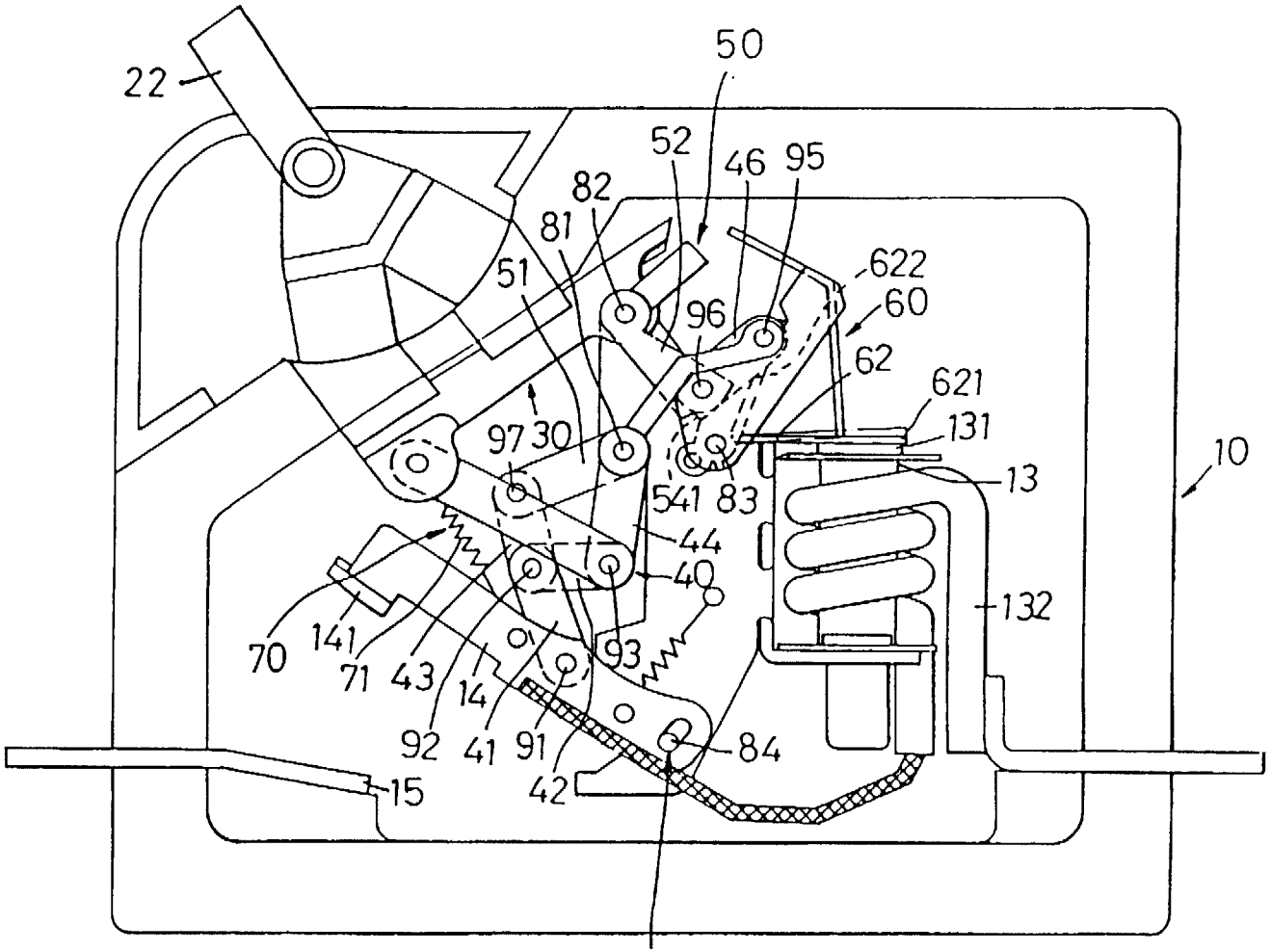
Figure 6:
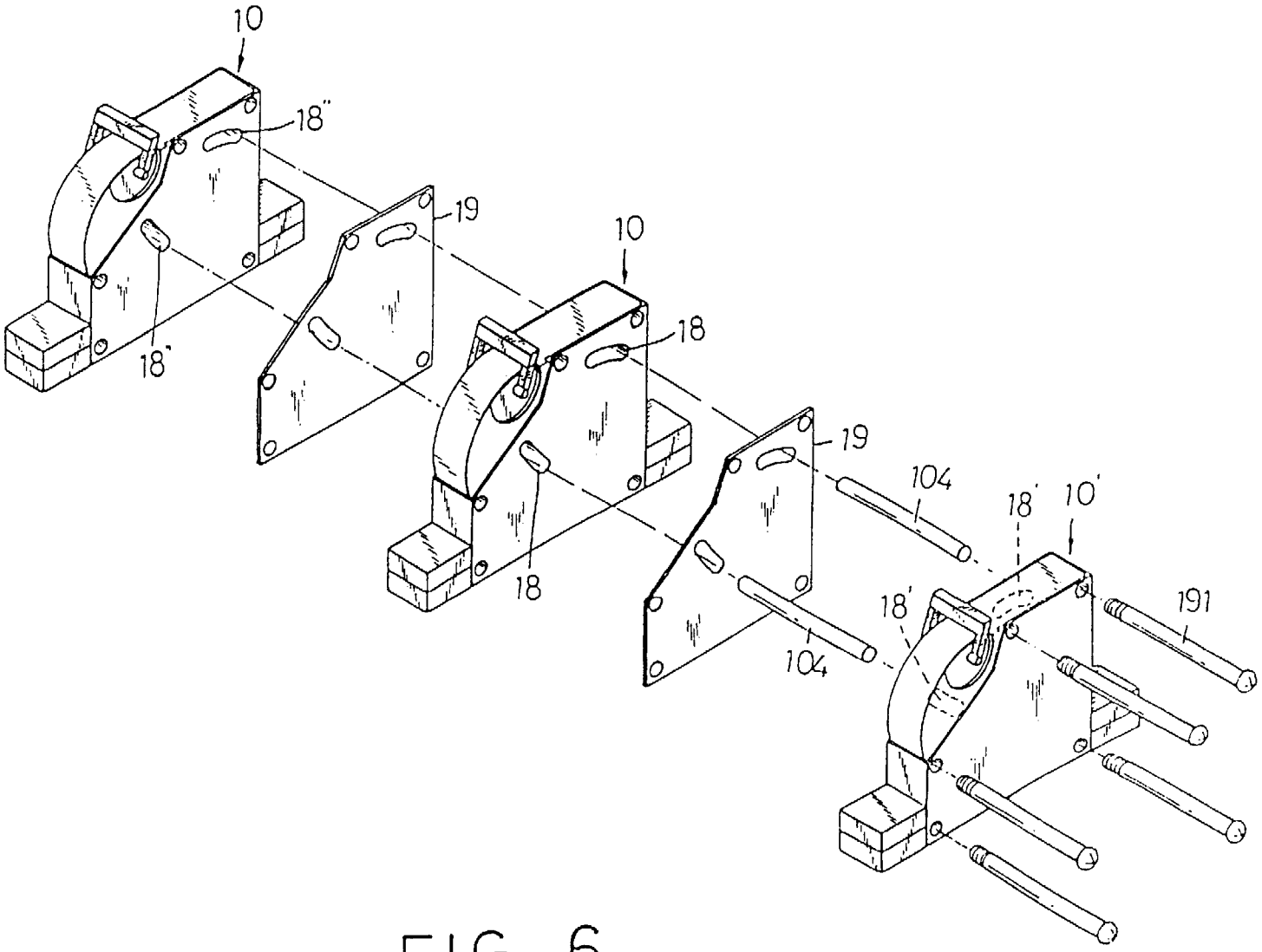
Figure 7:
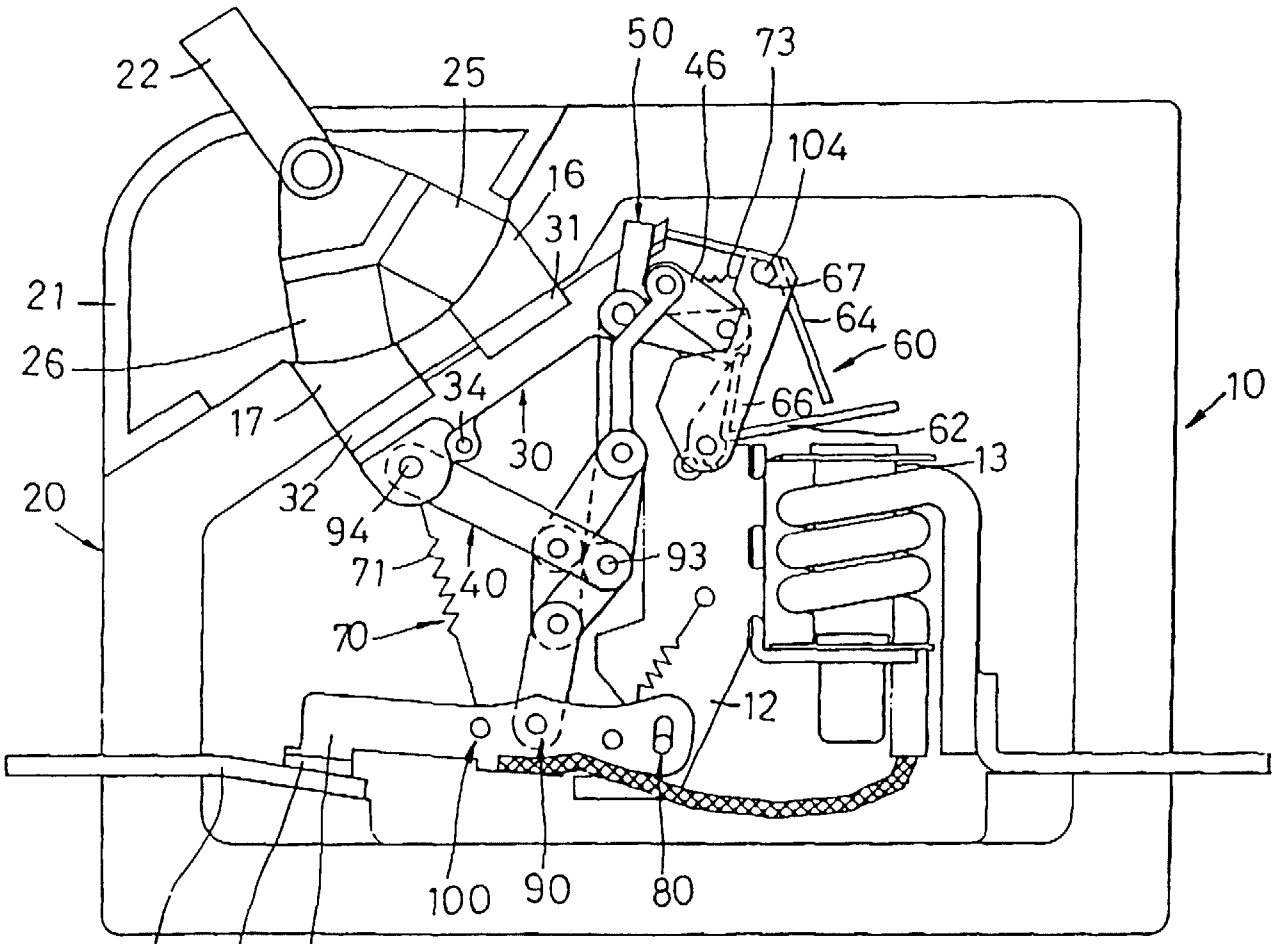

FIG. 4 a schematic view illustrating the preferred embodiment in an OFF position;

FIG. 5 is a schematic view illustrating the preferred embodiment in a trip position;

FIG. 6 is a perspective exploded view of a second preferred embodiment of a sealed electric switch assembly according to the present invention; and FIG. 7 is a schematic view of the second preferred embodiment illustrating the internal components one of the sealed electric switches of the electric switch assembly according to the present invention.

Before the present invention is disclosed in greater detail, it should be noted that like elements are denoted by like reference numerals throughout the disclosure.

Figure 1:
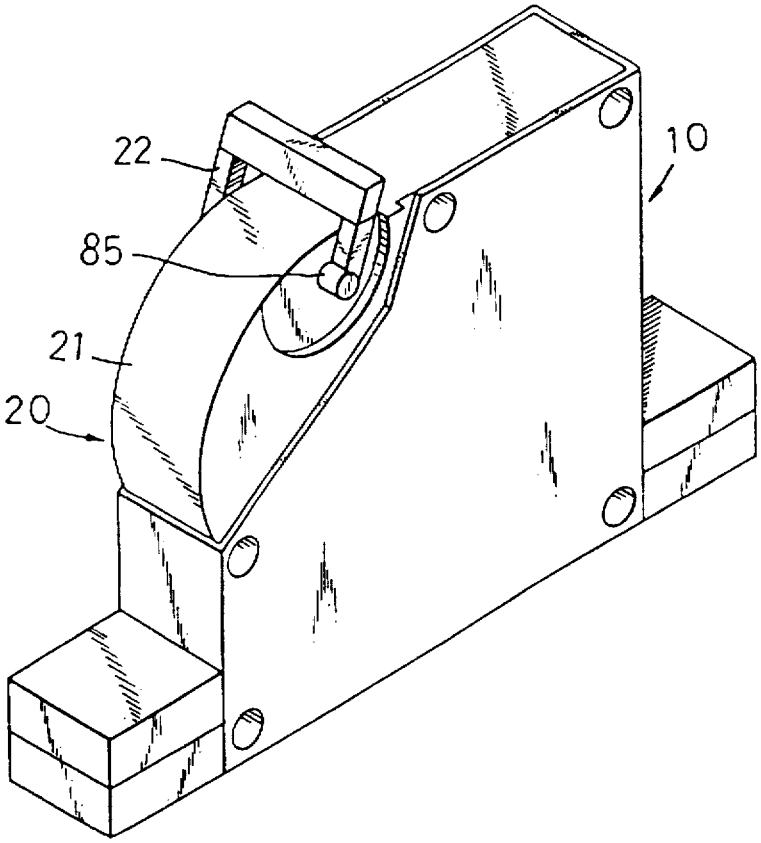
FIG. 1 is a perspective view of a preferred embodiment of a sealed electric switch assembly according to the present invention.
Figure 2:
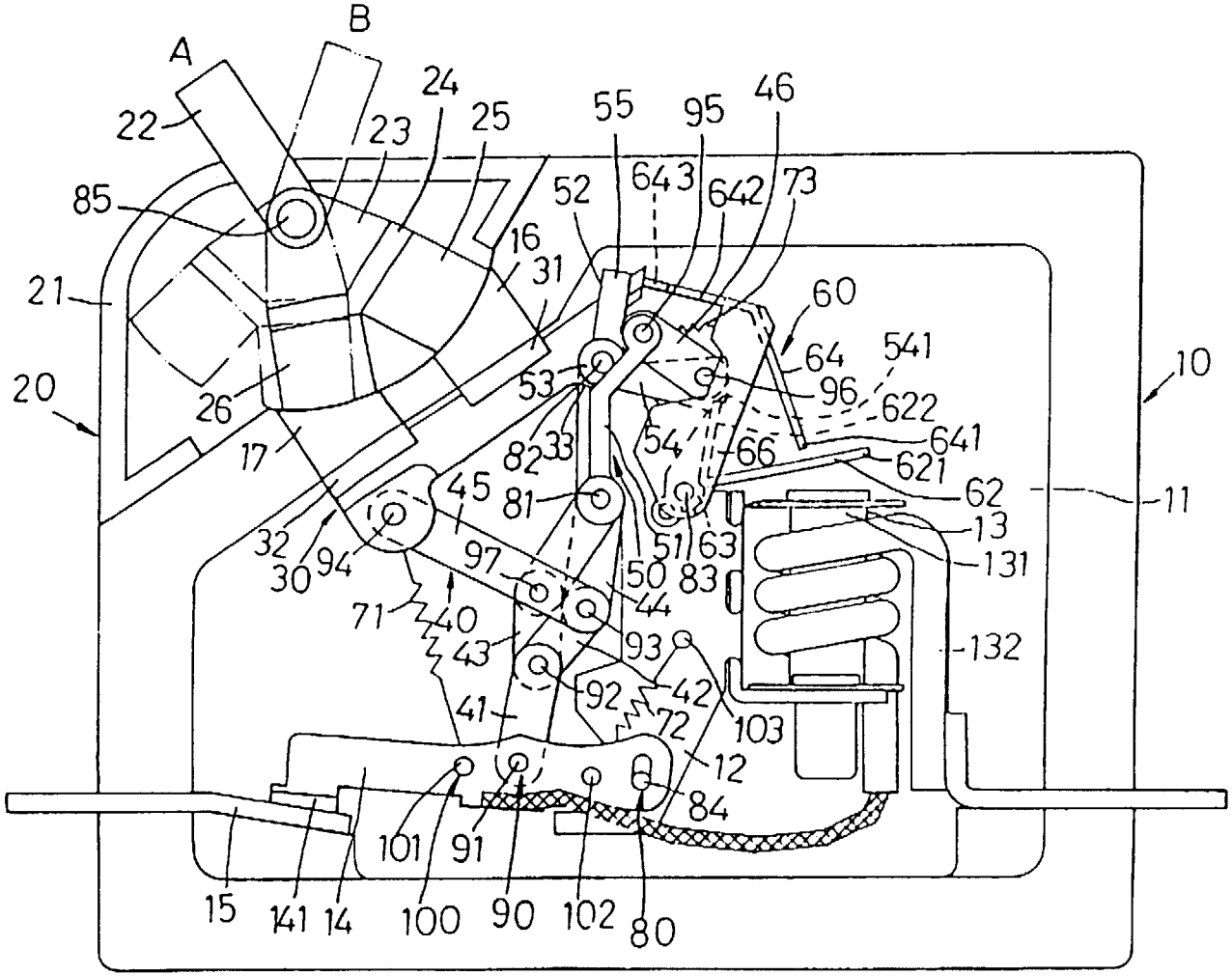
FIG. 2 is a schematic side view of the preferred embodiment illustrating the internal components of the sealed electric switch assembly according to the present invention.

Referring to FIGS. 1 and 2, a preferred embodiment of a sealed electric switch assembly is shown to comprise a sealed casing 10, a magnetic control assembly 20, an elongated plate member 30, a linkage mechanism 40, a rotary assembly 50, a tripping assembly 60, a plurality of spring members 70, a plurality of stationary pins 80, and a plurality of connecting pins 90.

The magnetic control assembly 20 is mounted to a sub-casing 21 which is fixed on a top wall of the casing 10. The plate member 30 is mounted within the casing 10 and is opposed to the magnetic control assembly 20. The linkage mechanism 40 is mounted adjacent to the plate member 30. The rotary assembly 50 is mounted between the linkage mechanism 40. The tripping assembly 60 is mounted above the linkage mechanism 40.

The casing 10 has a receiving space 11 therein. A mounting frame 12 is formed of two plates and is connected fixedly to the internal wall of the casing 10 in said receiving space 11 by means of first, second, third, fourth stationary pins 81, 82, 83, 84. An electromagnet 13 is fixed adjacent to the mounting frame 12. The electromagnet 13 has a core 131 and a coil 132 surrounding the core 131. A movable arm 14 is connected pivotally to the fourth stationary pin 84 at its first end at the bottom side of the mounting frame 12 and has a movable contact 141 fixed to its second end. A stationary contact 15 is fixed to the lower wall of the casing 10 under the movable contact 141. The magnetic control assembly 20 is mounted above the stationary contact 15 in the sub-casing 21.

The magnetic control assembly 20 has a fifth stationary pin 85 fixed in the sub-casing 21, an actuating lever 22 which is connected pivotally to the fifth stationary pin 85 at its lower end. The lower end of the actuating lever 22 is connected in turn to a magnetic seat 23 and a soft iron 24. First and second magnetic members 25, 26 are connected spacedly thereto. The first and second magnetic members 25, 24 are permanent magnets of different magnetic polarities.

The elongated plate member 30 has an upper end which is connected pivotally to the second stationary pin 82 in the casing 10, and an upper side which faces the magnetic control assembly 20 and which has third and fourth magnetic members 31, 32 of different magnetic polarities. The first and third magnetic members 25, 31 are of different magnetic polarities and the second and fourth magnetic members 26, 32 are of different magnetic polarities so that the first and third magnetic members 25, 31 and the second and fourth magnetic members 26, 32 can be attracted magnetically to one another when they are aligned with one another. In the casing 10, a first bridging magnet 16 is disposed between the first and third magnetic members 25, 31 and a second bridging magnet 17 is disposed between the second and fourth magnetic members 26, 32 so as to enhance the magnetic attractive force therebetween.

The linkage mechanism 40 includes first, second, third, fourth, fifth and sixth linkages 41, 42, 43, 44, 45, 46. The first linkage 41 is connected pivotally to the intermediate portion of the movable arm 14 at its lower end by means of a first connecting pin 91. The second linkage 42 is connected pivotally to the upper end of the first linkage 41 at its lower end by means of a second connecting pin 92. The third linkage 43 is connected pivotally to the upper end of the first linkage 41 by means of the second connecting pin 92. A fourth linkage 44 is connected pivotally to the upper end of the second linkage 42 at its lower end by means of a third connecting pin 93 and is connected pivotally to the first stationary pin 81 at its upper end. A fifth linkage 45 is connected pivotally to the lower end of the plate member 30 at its upper end by means of a fourth connecting pin 94 and is connected pivotally to the lower end of the fourth linkage 44 at its lower end by means of the third connecting pin 93. The sixth linkage 46 has two ends which are connected pivotally to rotary assembly 50 on the upper portion of the casing 10 by means of fifth and sixth connecting pins 95, 96.

The rotary assembly 50 includes a Z-shaped lever 51 and an L-shaped lever 52. The Z-shaped lever 51 has an upper end connected pivotally to the upper end of the sixth linkage 46 by means of the fifth connecting pin 95, an intermediate portion which is connected pivotally to the first stationary pin 81, and a lower end which is connected pivotally to the upper end of the third linkage 43. The L-shaped lever 52 has a bent portion 53 which is connected pivotally to the second stationary pin 82, a first arm portion 54 which has a distal end that is connected pivotally to the lower end of the sixth linkage 46, and a second arm portion 55 extending upwardly from the bent portion 53. The distal end of the first arm portion 54 of the L-shaped lever 52 has a notch 541.

The tripping assembly 60 includes an L-shaped catch member 62 and an inverted V-shaped member 64. The L-shaped catch member 62 has a connecting seat 63 which is connected pivotally to the third stationary pin 83, a first arm portion 622 having a distal end which abuts against the distal end of the first arm portion 54 of the L-shaped lever 52 in order to prevent the L-shaped lever 52 from being rotated clockwise, and a second arm portion 621 which extends over the electromagnet 13.

The inverted V-shaped member 64 has an engaging seat 66 which extends from a bent portion thereof and which has a distal end that is connected pivotally to the third stationary pin 83, a right arm portion 641 having a distal end which extends over the second arm portion 621 of the L-shaped catch member 62, and a left arm portion 642 having a distal end which abuts the second arm portion 55 of the L-shaped lever 52. The distal end of the left arm portion 642 of the inverted V-shaped member 64 has a notch 643 with which the second arm portion 55 of the L-shaped lever 52 is engaged. The distal end of the first arm portion 622 of the L-shaped catch member 62 is engaged with the notch 541 of the L-shaped lever 52.

The spring members 70 includes first, second and third tension springs 71, 72, 73. The first tension spring 71 interconnects the lower end of the elongated plate member 30 and a first engaging pin 101 which is fixed to the right side of the first connecting pin 91 on the movable arm 14. The second tension spring 72 interconnects a second engaging pin 102 which is fixed to the mounting frame 12 and the left side of the first connecting pin 91 of the movable arm 14 in order to urge the movable contact 141 to contact the stationary contact 15. The third tension spring 73 interconnects the fifth connecting pin 95 at the upper end of the sixth linkage 46 and the right arm portion 641 of the inverted V-shaped member 64 in order to urge the distal end of the left arm portion 642 of the inverted V-shaped member 64 to abut the second arm portion 55 of the L-shaped lever 52.

The utilization and the principles of the present invention are described hereinbelow.

Figure 3:
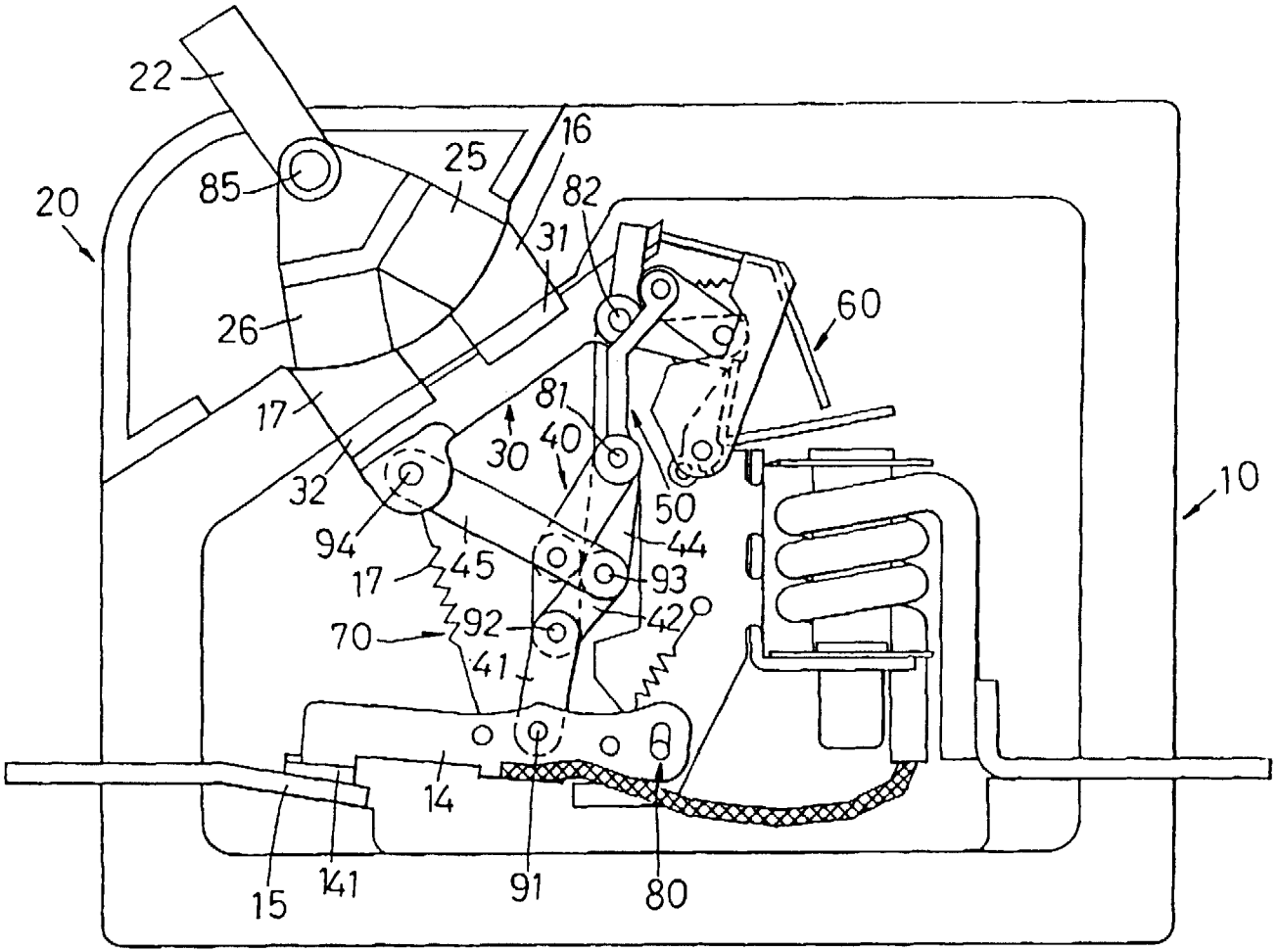
FIG. 3 is a schematic view illustrating the preferred embodiment in an ON position.

First, referring to FIG. 3, the circuit is normally in an ON state while the actuating lever 22 is in the position "A" as shown in FIG. 2. The first and second magnetic members 25, 26 are attracted magnetically to the third and fourth magnetic members 31, 32 of the elongated plate member 30 through the first and second bridging magnets 16, 17. The movable contact 141 of the movable arm 14 abuts the stationary contact 15 by means of the linkage mechanism 40. At this time, the first tension spring 71 is stretched under tension.

Referring to FIGS. 2 and 4, when the actuating lever 22 is rotated to the position "B", the first and second magnetic members 25, 26 is rotated clockwise by an angle such that the first magnetic member 25 is aligned with the fourth magnetic member 32, resulting in the repulsion of the first and fourth magnetic members 25, 32. The repulsion force of the first and fourth magnetic members 25, 32 causes the elongated plate member 30 to rotate counterclockwise about the second stationary pin 82, enabling the fourth connecting pin 94 to push the fifth linkage 45 and the third connecting pin 93 to move. The movement of the third connecting pin 93 permits the fourth linkage 44 and therefore the second and the first linkages 42, 41 to move upward. Thereby, the movable arm 14 is rotated clockwise about the fourth stationary pin 84 with the aid of the restore force of the first tension spring 72. Therefore, the circuit is in an OFF state, i.e. the circuit is opened.

Referring to FIGS. 2 and 5, when the circuit is in an over-loaded or short-circuit state, the current in the coil 132 of the electromagnet 13 will increase dramatically, producing a large magnetic force from the core 131 such that the core 131 attracts the second arm portion 621 of the L-shaped catch member 62. This will causes the L-shaped catch member 62 to rotate clockwise about the third stationary pin 83 to permit the first arm portion 622 of the L-shaped catch member 62 to disengage from the notch 541 of the L-shaped lever 52. The L-shaped lever 52 is then rotated clockwise about the second stationary pin 82 to push the sixth linkage 46 to move right, permitting the Z-shaped lever 51 to rotate about the first stationary pin 81. The rotation of the Z-shaped lever will cause the upward movement of the third linkage 43 and the first linkage 41. Thereby, the movable arm 14 is rotated clockwise about the fourth stationary pin 84 to permit the movable contact 141 to move away from the stationary contact 15. Therefore, the electric switch assembly of the present invention is in a trip position in which the circuit is opened.

With reference to FIGS. 2 and 5, when the electric switch of the present invention is desired to be reset after the electric switch assembly is tripped and the circuit is opened, the actuating lever 22 is first rotated to the position "B" in order to allow the electric switch assembly to be converted from an ON position to an OFF position. In the OFF position, the repulsion force of the first and fourth magnetic members 25, 32 permits the fifth linkage 45, the fourth linkage 44, the second linkage 42, and the third linkage 43 to move until the movable contact 141 to contact the stationary contact 15, as shown in FIG. 2. Meanwhile, the Z-shaped lever 51 is rotated counterclockwise about the first stationary pin 81 to permit the sixth linkage 46 to move counterclockwise and permit the L-shaped lever 52 to rotate counterclockwise about the second stationary pin 82 until the first arm portion 622 of the L-shaped catch member 62 engages the notch 541 of the L-shaped lever 52. At this time, the notch 643 of the left arm portion 642 of the inverted V-shaped member 64 will strike on the second arm portion 55 of the L-shaped lever 52 by means of the restore force of the third tension spring 73 in order to obtain a positive engagement of the first arm portion 622 of the L-shaped catch member 62 and the notch 541 of the L-shaped lever 52. Thereby, the electric switch assembly of the present invention is switched from a trip position to a reset position.

FIG. 6 shows a second preferred embodiment of a seal electric switch assembly which is to be used in a three-phrase circuit according to the present invention. The electric switch assembly comprises three sealed electric switches juxtaposed to one another. In this embodiment, each of the electric switches has a structure which is similar to that of the electric switch assembly of the first embodiment except that the elongated plate member 30 has a first connecting hole 34 formed therein and the inverted V-shaped member 64 has a second connecting hole 67 formed therein, as best illustrated in FIG. 7. The casing 10 of the switches 10, 10', 10" have adjacent side walls. Each of the opposite side walls of the casing 10 of the middle switch has first and second arcuate grooves 18. The left side wall of the casing 10" of the left switch has first and second arcuate grooves 18'. The right side wall of the casing 10" of the right switch has first and second arcuate grooves 18". The first and second arcuate grooves 18, 18', 18" are formed respectively adjacent to the first and second connecting holes 34, 67 and are aligned with one another. Two non-conductive connecting rods 104 pass respectively through the first and second connecting holes 34, 67 and the first and second arcuate grooves 18, 18', 18" so that the elongated plate members 30 and the tipping assemblies 60 of the sealed electric switch assembly are coupled to one another. Therefore, when the one of the sealed electric switches is switched from the ON position to the trip position, the tipping assemblies 60 may be actuated synchronously. Similarly, when one of the electric switches is switched from the OFF position to the ON position, the elongated plate members 30 may be actuated synchronously. Two water-proof pads 19 are provided between the casings 10, 10', 10". The casings 10, 10', 10" are secured to one another by means of four fastening members 191.

The advantages of the present invention are as follows.

1. Since the electric switch assembly of the present invention has a sealed structure, a vacuum can be maintained within the casing. Alternatively, the casing may be filled with an inert gas. Therefore, the components within the casing can prevent from corrosion and maintain good sensitivity.

2. When an emergency is encountered by the circuit, the electric switch assembly can be switched automatically from an ON position to an trip position in order to open the circuit. Therefore, the electric switch assembly is safe.

3. The electric switch assembly can be protected from moisture, dust and corrosion in order to be used in various environments.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangement.

We claim:

1. A sealed electric switch assembly, comprising:

a sealed casing having a receiving space therein, a mounting frame connected fixedly to the internal wall of said casing in said receiving space by means of first, second, third, fourth stationary pins, an electromagnet fixed adjacent to said mounting frame, a movable arm having a first end which is connected pivotally to said fourth stationary pin and a second end which has a movable contact, and a stationary contact fixed to the lower wall of said casing under said movable contact, said movable contact contacting normally said stationary contact;

a magnetic control assembly mounted to a subcasing fixed on a top wall of said casing and having a fifth stationary pin fixed in said subcasing, an actuating lever connected pivotally to said fifth stationary pin at its lower end, said lower end of said actuating lever having first and second magnetic members connected respectively thereto, said first and second magnetic members being of different magnetic polarities;

an elongated plate member having a lower end and an upper end which is connected pivotally to said second stationary pin in said casing, and an upper side which faces said magnetic control assembly and which has third and fourth magnetic members of different magnetic polarities, said first and third magnetic members being of different magnetic polarities, said second and fourth magnetic members being of different magnetic polarities so that said first and third magnetic members and said second and fourth magnetic members can be attracted magnetically to one another when they are aligned with one another;

a linkage mechanism including a first linkage having a lower end which is connected pivotally to said movable arm, a second linkage having a lower end which is connected pivotally to an upper end of said first linkage, a third linkage having a lower end which is connected pivotally to the upper end of said first linkage, a fourth linkage having a lower end which is connected pivotally to an upper end of said second linkage and an upper end which is connected pivotally to said first stationary pin, a fifth linkage having a upper end which is connected pivotally to said lower end of said elongated plate member and a lower end which is connected pivotally to said lower end of said fourth linkage, and a sixth linkage connected pivotally to an upper portion of said casing;

a rotary assembly including a Z-shaped lever and an L-shaped lever, said Z-shaped lever having an upper end connected pivotally to an upper end of said sixth linkage, an intermediate portion which is connected pivotally to said first stationary pin, and a lower end connected pivotally to the upper end of said third linkage, said L-shaped lever having a bent portion which is connected pivotally to said second stationary pin, a first arm portion which has a distal end that is connected pivotally to a lower end of said sixth linkage, and a second arm portion extending upwardly from said bent portion;

a tripping assembly including an L-shaped catch member and an inverted V-shaped member, said L-shaped catch member having a connecting seat which is connected pivotally to said third stationary pin, a first arm portion having a distal end which abuts against said distal end of said first arm portion of said L-shaped lever in order to prevent said L-shaped lever from being rotated clockwise, and a second arm portion which extends over said electromagnet, said inverted V-shaped member having an engaging seat which extends from a bent portion thereof and which has a distal end that is connected pivotally to said third stationary pin, a right arm portion having a distal end which extends over said second arm portion of said L-shaped catch member, and a left arm portion having a distal end which abuts said second arm portion of said L-shaped lever;

a first tension spring interconnection said lower end of said elongated plate member and said movable arm in order to facilitate the movement of said movable contact away from said stationary contact when said actuating lever is rotated to permit said first and fourth magnetic members to align with and repulse one another;

a second tension spring interconnecting said mounting frame and said movable arm in order to urge said movable contact to contact said stationary contact; and a third tension spring interconnecting said upper end of said sixth linkage and said right arm portion of said inverted V-shaped member in order to urge said distal end of said left arm portion of said inverted V-shaped member to abut said second arm portion of said L-shaped lever.

2. A sealed electric switch assembly as claimed in claim 1, wherein the distal end of said first arm portion of said L-shaped lever has a notch with which the distal end of said first arm portion of said L-shaped catch member is engaged.

3. A sealed electric switch assembly as claimed in claim 1, wherein the distal end of said left arm portion of said inverted V-shaped member has a notch with which said second arm portion of said L-shaped lever is engaged.

4. A sealed electric switch assembly as claimed in claim 1, wherein said casing has a first bridging magnet disposed thereon between said first and third magnetic members and has a second bridging magnet disposed thereon between said second and fourth magnetic members.

5. A sealed electric switch assembly, comprising:

three sealed electric switches juxtaposed and connected to one another, each of said sealed electric switches including:

a sealed casing having a receiving space therein, a mounting frame connected fixedly to the internal wall of said casing in said receiving space by means of first, second, third, fourth stationary pins, an electromagnet fixed adjacent to said mounting frame, a movable arm having a first end which is connected pivotally to said fourth stationary pin and a second end which has a movable contact, and a stationary contact fixed to the lower wall of said casing under said movable contact, said movable contact contacting normally said stationary contact;

a magnetic control assembly mounted to a subcasing fixed on a top wall of said casing and having a fifth stationary pin fixed in said sub-casing, an actuating lever connected pivotally to said fifth stationary pin at its lower end, said lower end of said actuating lever having first and second magnetic members connected respectively thereto, said first and second magnetic members being of different magnetic polarities;

an elongated plate member having a lower end and an upper end which is connected pivotally to said second stationary pin in said casing, and an upper side which faces said magnetic control assembly and which has third and fourth magnetic members of different magnetic polarities, said first and third magnetic members being of different magnetic polarities, said second and fourth magnetic members being of different magnetic polarities so that said first and third magnetic members and said second and fourth magnetic members can be attracted magnetically to one another when they are aligned with one another, said plate member further having a first connecting hole formed therein;

a linkage mechanism including a first linkage having a lower end which is connected pivotally to said movable arm, a second linkage having a lower end which is connected pivotally to an upper end of said first linkage, a third linkage having a lower end which is connected pivotally to the upper end of said first linkage, a fourth linkage having a lower end which is connected pivotally to an upper end of said second linkage and an upper end which is connected pivotally to said first stationary pin, a fifth linkage having a upper end which is connected pivotally to said lower end of said elongated plate member and a lower end which is connected pivotally to said lower end of said fourth linkage, and a sixth linkage connected pivotally to an upper portion of said casing;

a rotary assembly including a Z-shaped lever and an L-shaped lever, said Z-shaped lever having an upper end connected pivotally to an upper end of said sixth linkage, an intermediate portion which is connected pivotally to said first stationary pin, and a lower end connected pivotally to the upper end of said third linkage, said L-shaped lever having a bent portion which is connected pivotally to said second stationary pin, a first arm portion which has a distal end that is connected pivotally to a lower end of said sixth linkage, and a second arm portion extending upwardly from said bent portion;

a tripping assembly including an L-shaped catch member and an inverted V-shaped member, said L-shaped catch member having a connecting seat which is connected pivotally to said third stationary pin, a first arm portion having a distal end which abuts against said distal end of said first arm portion of said L-shaped lever in order to prevent said L-shaped lever from being rotated clockwise, and a second arm portion which extends over said electromagnet, said inverted V-shaped member having an engaging seat which extends from a bent portion thereof and which has a distal end that is connected pivotally to said third stationary pin, a right arm portion having a distal end which extends over said second arm portion of said L-shaped catch member, and a left arm portion having a distal end which abuts said second arm portion of said L-shaped lever, said inverted V-shaped member further having a second connecting hole formed therein;

a first tension spring interconnecting said lower end of said elongated plate member and said movable arm in order to facilitate the movement of said movable contact away from said stationary contact when said actuating lever is rotated to permit said first and fourth magnetic members to align with and repulse one another;

a second tension spring interconnecting said mounting frame and said movable arm in order to urge said movable contact to contact said stationary contact;

a third tension spring interconnecting said upper end of said sixth linkage and said right arm portion of said inverted V-shaped member in order to urge said distal end of said left arm portion of said inverted V-shaped member to abut said second arm portion of said L-shaped lever;

said casings having adjacent side walls, each of said adjacent side walls having first and second arcuate grooves which are formed respectively adjacent to said first and second connecting holes; and two non-conductive rods passing respectively through said first and second connecting holes and said first and second arcuate grooves so that said elongated plate members and said inverted V-shaped members are coupled to one another.

* * * * *